US005644969A

United States Patent [19]

Leu et al.

[11] Patent Number: 5,644,969

[45] Date of Patent: Jul. 8, 1997

[54] WOBBLE PISTON AND CYLINDER ARRANGEMENT

[75] Inventors: Shawn A. Leu, Sheboygan; Mark A. Schuessler, Sheboygan Falls, both of Wis.

[73] Assignee: Thomas Industries Inc., Sheboygan, Wis.

[21] Appl. No.: 671,985

[22] Filed: Jun. 28, 1996

[51] Int. Cl.[6] ..... F01B 31/14; F01B 11/02

[52] U.S. Cl. ..... 92/60.5; 92/169.1; 92/172

[58] Field of Search ..... 92/60.5, 240, 172, 92/169.1

[56] References Cited

U.S. PATENT DOCUMENTS 3,961,868 6/1976 Droege, Sr. et al. ..... 417/550

4,467,605 8/1984 Smith ..... 92/60.5 X 4,775,299 10/1988 Overfield et al. ..... 92/60.5 X 4,782,738 11/1988 Jackson et al. ..... 92/60.5

5,092,224 3/1992 Rozek ..... 92/109

*Primary Examiner*—Hoang Nguyen

*Attorney, Agent, or Firm*—Quarles & Brady

[57] ABSTRACT

A wobble piston usable in a cylinder comprising one or both of the confronting surfaces of wobble piston head or valve plate being convexly curved in the plane of the wobble motion and being straight in a plane that is transverse to the plane of the wobble motion.

12 Claims, 2 Drawing Sheets

WOBBLE PISTON AND CYLINDER ARRANGEMENT

BACKGROUND OF THE INVENTION

This invention relates to wobble pistons, and more particularly to a wobble piston and cylinder arrangement that minimizes clearance volume.

Wobble pistons are used in oilless air compressors and vacuum pumps. They include a peripheral seal on the piston head that engages the cylinder bore. The piston head and its connecting rod are fixed to each other, and the connecting rod is mounted on an eccentric on a shaft. As the eccentric is turned by the shaft, the wobble piston will be moved in and out and will "wobble" from side to side. Examples of wobble pistons are found in U.S. Pat. No. 3,961,868 issued Jun. 8, 1976, for "Air Compressor" and U.S. Pat. No. 5,092,224 issued Mar. 3, 1992, for "Conical Rod Piston".

A valve plate typically closes the open top end of the cylinder bore. At the top dead center position of the piston within the cylinder, some clearance must be provided between the top of the piston head and the valve plate, even if the valve plate is flat. The amount of clearance necessary depends upon the accumulated tolerances. However, as the wobble piston leaves top dead center, the tilting motion of the connecting rod results in one side of the piston head traveling higher than the center of the head. Typically, points along the diameter of the piston head will reach their maximum heights within the first 25° of motion away from top dead center. If the top of the piston head is flat and the valve plate is flat, the length of the connecting rod must be adjusted for this worst tip clearance condition. The result is that the clearance volume at top dead center must be increased. This results in lower pressures within the cylinder and lower efficiencies.

One solution to the clearance volume problem has been to use symmetrical bevels at the top edges of the piston head to allow a longer rod length and resulting in a lower clearance volume. The small amount of volume added by the bevels at top dead center condition, is outweighed by the volume reduction from a longer connecting rod. Another solution has been to use a dome-shaped piston head.

The present invention is directed to further optimizing the clearance volume without the need for tighter tolerances.

SUMMARY OF THE INVENTION

In accordance with the invention, a fluid pumping apparatus has a cylinder with a valve plate forming the top end of the cylinder. A wobble piston has a piston head operating in the cylinder and a piston rod mounted to move in a single plane. The surface of the valve plate and the piston head that confront each other are straight in a plane transverse to the plane of motion of the piston and one or both of the surfaces are curved convexly in the plane of motion.

Preferably, the fluid pumping apparatus has a cylinder with a flat valve plate forming the top end of the cylinder. The top surface of the piston head is curved in the plane of motion of the piston rod. The curve of the top surface approximates the locus of all points of the top surface that are nearest to the valve plate as the piston rod moves through the plane. Preferably, the curve on the piston head is a third order polynomial. The polynomial may be approximated by the arcs of two identical circles, the centers of which are equally offset from the longitudinal centerline of the piston.

The curved surface of the piston head may be formed in a retainer that secures a cup seal to the piston head.

Alternatively, the surface of the valve plate may be provided with the convex curve, or both confronting surfaces of the valve plate and piston head may be provided with a convex curve such that the net clearance distance between the surfaces at any distance from the centerline of the piston will approximate the clearance distance achieved by curving only one of the surfaces.

It is a principal object of the invention to minimize the clearance volume in a wobble piston/cylinder arrangement.

The foregoing and other objects and advantages of the invention will appear in the following retailed description. In the description, reference is made to the accompanying drawings which illustrate preferred embodiments of the invention.

DETAILED DESCRIPTION OF THE INVENTION

Figure 1:
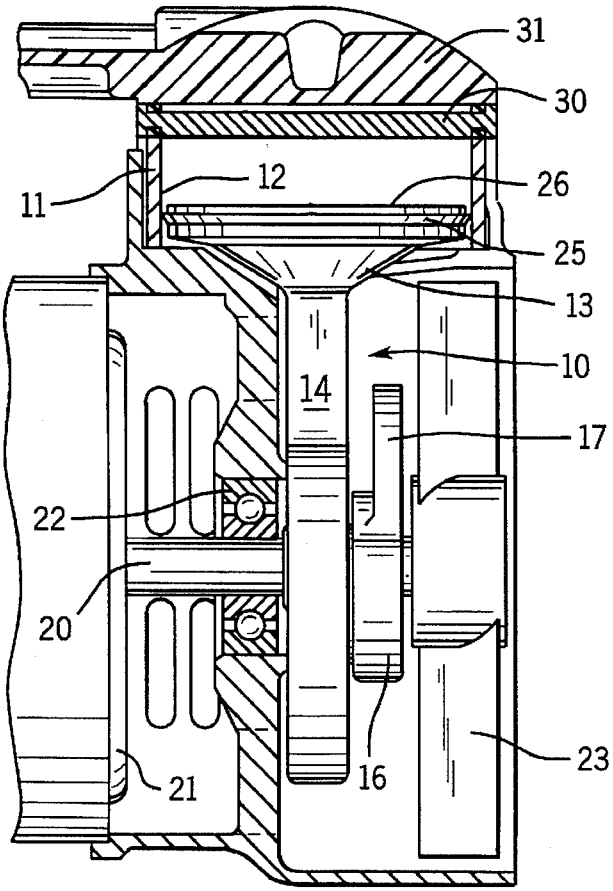
FIG. 1 is a view in vertical section through a piston/cylinder arrangement in an air compressor.

Referring to FIG. 1, a wobble piston 10 typically operates in a cylinder sleeve 11 having a circular cylinder bore 12. The wobble piston 10 includes a piston head 13 and a connecting rod 14 which may be integral or otherwise rigidly fixed to each other. The connecting rod 14 mounts a ball bearing 15 which in turn is mounted on an eccentric 16 that includes a counter weight 17. The eccentric 16 is attached to the output shaft 20 of an electric motor 21. The motor shaft 20 is received in bearings 22 mounted in a housing. The motor shaft also mounts a cooling fan 23.

The piston head 13 includes a cup seal 25 formed of teflon or similar material and held in place by a cup retainer 26 joined to the piston head 13 by a central screw 27. The cylinder 11 mounts a valve plate 30 on its open top and a head 31 is mounted on the valve plate 30. The valve plate 30 typically contains flapper inlet and exhaust valves (not shown) and the head 31 has inlet and exhaust chambers in communication with the flapper valves.

Figure 3:
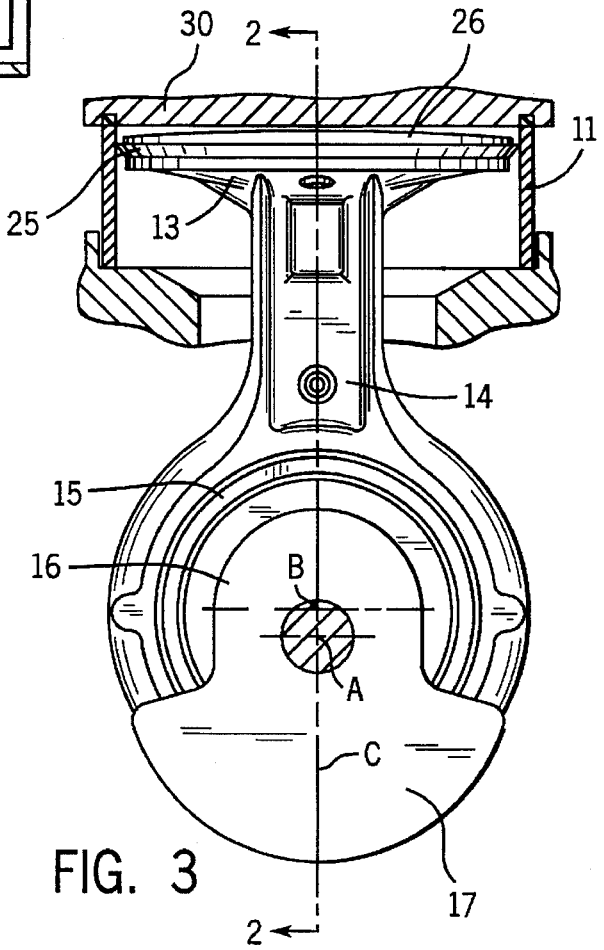
FIG. 3 is a view in elevation of the piston of FIG. 2.
Figure 2:
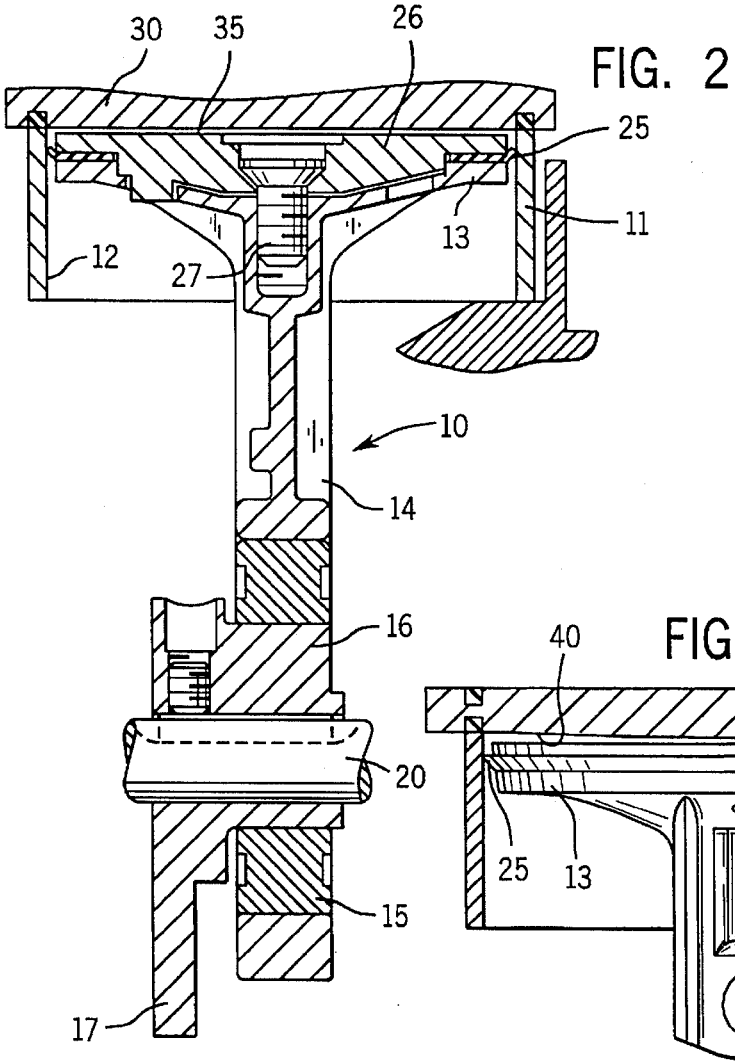
FIG. 2 is a view in vertical section of the piston, cylinder, and valve plate of FIG. 1.

As shown in FIGS. 2 and 3, the axial centerline A of the motor shaft is offset from the axial centerline B of the connecting rod 14. As the motor shaft 20 rotates, the centerline B will rotate about the motor shaft centerline A and the wobble piston 10 will be moved in and out of the cylinder 11 and back and forth in the plane of the view that is FIG. 3. This is the plane of motion of the wobble piston 10. In the plane of the cross-section of FIG. 2, which is transverse to the plane of motion, the top surface 35 of the cup retainer 26 is straight so that the clearance between the top surface 35 and the bottom of the valve plate 30 is equal at all points along the diameter of the cup retainer 26. In the plane of motion, however, the top surface 35 of the cup retainer 26 is convexly curved so that the clearance distance at the longitudinal centerline C of the piston is minimal and the clearance increases as the distance from the centerline C to the perimeter increases.

Ideally, the curve on the top surface 35 is a third order polynomial $y=Ax^3-Bx^2-Cx-D$ where y is the height above the plane through the cup retainer 26 and x is the distance from the centerline C of the piston.

Figure 4:
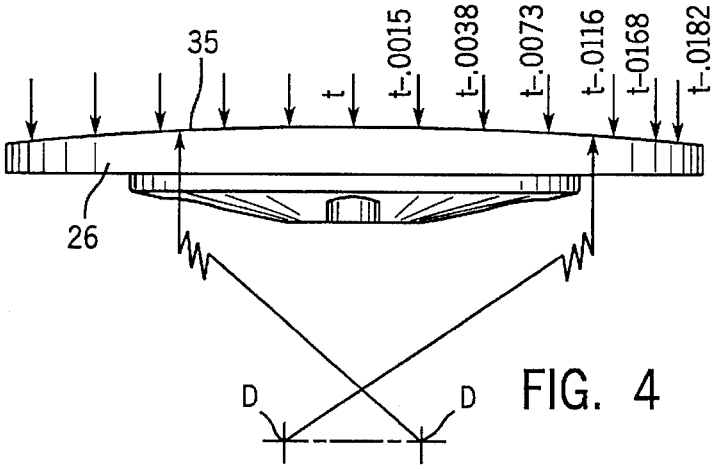
FIG. 4 is an enlarged view of the cup retainer showing the curved upper surface.

For ease of fabrication, the third order polynomial curve can be closely approximated using arcs of two identical circles whose centers D are equally offset from the centerline C of the piston, as shown in FIG. 4. In FIG. 4, the change in thickness of the retainer cup 26 for a typical wobble piston is shown.

Figure 5:
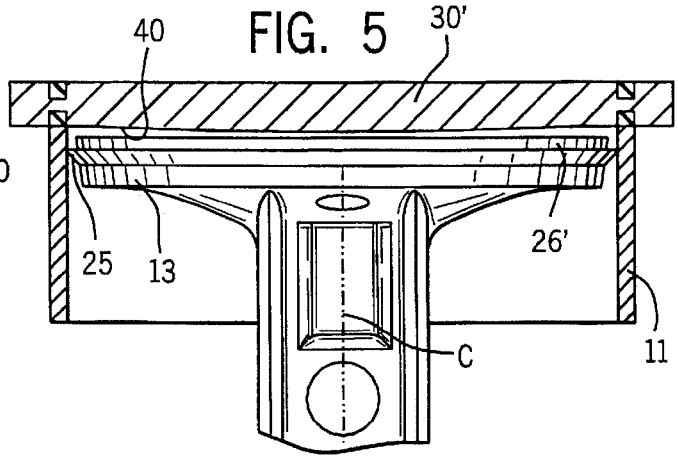
FIG. 5 is a view in elevation and partially in section of an alternative embodiment using a curved valve plate.

FIG. 5 shows an alternative embodiment in which the top surface of the cup retainer 26' is flat in all planes, and the bottom surface 40 of the valve plate 30' is convexly curved in the plane of the piston motion and straight in the plane transverse to the piston motion. Once again, the convex curve for the bottom valve plate surface 40 is ideally a third order polynomial, and it may be approximated using arcs of two identical circles.

Another alternative is to convexly curve both confronting surfaces of the piston head and valve plate such that the sum of the curves is the same as the curve on either the piston head or valve plate.

The curved piston head or valve plate of the current invention provides the tightest possible clearance volume for a given stroke, rod length, and reasonable tolerances. If the piston head were domed, clearance volume would be lost in planes transverse to the plane of motion of the piston. Curving the piston head in only a single plane minimizes the clearance volume.

We claim:

1. In a piston head for a wobble piston usable in a cylinder having a flat upper end, the improvement wherein:

the upper surface of the piston head is curved convexly in the plane of the wobble motion of the piston and is straight in a plane that is transverse to the plane of the wobble motion.

2. A piston head in accordance with claim 1 wherein the curve is a third order polynomial.

3. A piston head in accordance with claim 1 wherein the curve is formed as the arc of two identical circles the centers of which are equally offset from the longitudinal centerline of the piston, and the curve approximates a third order polynomial.

4. In a fluid pumping apparatus having a cylinder with a flat valve plate forming the top end of the cylinder and a wobble piston with a piston head operating in the cylinder and a piston rod mounted to move in a plane normal to the valve plate, the improvement wherein:

the top surface of the piston head is curved convexly in the plane of the motion of the piston rod and is straight in a plane transverse to said plane of motion.

5. An apparatus in accordance with claim 4, wherein the curve of the top surface approximates the locus of all points of the top surface that are nearest to the valve plate as the piston rod moves through said plane of motion.

6. An apparatus in accordance with claim 4, wherein the curve approximates a third order polynomial.

7. A wobble piston, comprising:

a piston rod;

a piston head fixed to the piston rod;

a cup seal mounted on the head; and a cup retainer securing the cup seal to the piston head, the retainer having a top surface that is curved convexly in one plane and straight in the plane transverse to the one plane.

8. A wobble piston in accordance with claim 7, wherein the curve of the top surface approximates a third order polynomial.

9. In a fluid pumping apparatus having a cylinder with a valve plate forming the top end of the cylinder and a wobble piston with a piston head operating in the cylinder and a piston rod mounted to move in a single plane, the improvement wherein:

the surface of the piston head that confronts the valve plate is flat and the surface of the valve plate that confronts the piston head is curved convexly in the plane of the motion of the piston rod and is straight in a plane transverse to said plane of motion.

10. An apparatus in accordance with claim 9, wherein the curve of the surface of the valve plate approximates the locus of all points of the surface that are nearest to the piston head surface as the piston rod moves through said plane of motion.

11. An apparatus in accordance with claim 9, wherein the curve approximates a third order polynomial.

12. In a fluid pumping apparatus having a cylinder with a valve plate forming the top end of the cylinder and a wobble piston with a piston head operating in the cylinder and a piston rod mounted to move in a single plane, the improvement wherein:

the surfaces of the valve plate and piston head that confront each other are straight in a plane transverse to the plane of motion of the piston rod and one or both of the surfaces are curved convexly in the plane of the motion.

* * * * *